US005269096A

United States Patent [19]

Hade

[11] Patent Number: 5,269,096

[45] Date of Patent: Dec. 14, 1993

[54] REMOVABLE LIGHTWEIGHT WINDOW GUARD

[76] Inventor: René Hade, 2290 Brébeuf #4, Longuevil Q.C., Canada

[21] Appl. No.: 5,097

[22] Filed: Jan. 15, 1993

[51] Int. Cl.[5] ..... E06B 3/68

[52] U.S. Cl. ..... 49/57; 49/61

[58] Field of Search ..... 49/57, 50, 61, 141, 49/56, 55

[56] References Cited

U.S. PATENT DOCUMENTS

| | | | |
|---|---|---|---|
| 973,733 | 10/1910 | Wilson | 49/57 |
| 999,682 | 8/1911 | Suits | 49/57 |
| 1,634,843 | 7/1927 | McWane | 49/57 |
| 2,722,722 | 11/1955 | Mussman | 49/57 |
| 4,395,861 | 8/1983 | Fipke et al. | 49/50 X |
| 4,835,906 | 6/1989 | Collin | 49/57 |

*Primary Examiner*—Philip C. Kannan

*Attorney, Agent, or Firm*—Pierre Lespérance; François Martineau

[57] ABSTRACT

The window guard is mounted within the window frame, interiorly of the window panes. The window guard includes one pair of studs, anchored to opposite legs of the window frame, and a number of bars, interconnecting the studs through the window aperture to prevent unauthorized passage therethrough. The first stud includes transverse bores, for axial engagement by one end of the bars, while the second stud includes transverse notches, for transverse engagement by the other end of the bars. A latch bar is movably mounted inside the second stud, for releasably hooking the rods to the second stud. The latch bar is controlled by a pivotal lever, actuated by a key-operated lock barrel. The lock barrel is accessible only from the inside of the room.

10 Claims, 6 Drawing Sheets

REMOVABLE LIGHTWEIGHT WINDOW GUARD

FIELD OF THE INVENTION

This invention relates to window guards that prevent break-ins through a building window frame, while still allowing daylight into the building.

BACKGROUND OF THE INVENTION

U.S. Pat. No. 1,634,843 issued in 1927 to McWane, discloses a window guard having a plurality of horizontal rods 11 interconnecting two opposite lateral studs 7, 8. Studs 8 include transverse bores 9, while stud 7 includes transverse notches 13. Core extensions 10, 14, of each rod 11 at opposite ends thereof engage a corresponding bore 9 and a notch 13, respectively in studs 8, 7. A lock bar 16 is slidably mounted in the hollow notched stud 7, for releasably locking (with integral transverse pin 17) the rod core extension 14 in position against unauthorized egress from the notch 13.

The flaw in the McWane device is clear: the burglar needs only to break the glass of the window pane, to access the lock bar 16 and release the rods 11 from the studs 7, 8. This is not safe.

U.S. Pat. No. 4,395,861 issued on Aug. 3, 1983 to Fipke and Oswald, constitutes an improvement in two ways. First, the transverse window bars 4 include a central cylindrical metallic core 8 (FIG. 2) which is freely rotatable within the tube 4, so that any attempt at sawing the core 8 will bias the latter to rotate in the direction of sawing, thus in effect preventing effective sawing action (since there is no real grip of the saw teeth on the surface of the rod which surface moves with the saw blade during sawing motion). Second, the lock bar 15 (FIGS. 6 and 9), which releasably locks the ends of rods 4 into notched stud 4, is controlled by a stem 19 extending inwardly through the building wall 17. In its operative position, stem 19 prevents egress of the corresponding ends of rods 4 from the notches 14 (FIG. 7) of stud 2. Stem 19 is actuatable solely by a handle 21 located inside the building, at a distance from the window aperture, so that even if the window pane is shattered by a burglar, unauthorized access (from outside of the building) to the window guard release handle 21 will be denied.

Unfortunately with these known prior art window guards, the overall weight (transport costs) and manufacturing cost tend to be relatively high. Since these features are critical in this intensively competitive market, they do have an impact on projected sales. Studies have shown that current window guards (either of the grid type, or of the adjustable bar length type) tend to be considered as unaesthetic (customers complain of being like inside a prison).

It is understood that all window guards are now required by law to be releasable from the inside, so as to constitute an escape passageway in case of fire inside the building.

OBJECTS OF THE INVENTION

The main object of the invention is therefore to address the drawbacks of existing window guards as outlined in the preceeding paragraph, particularly with respect to weight and cost parameters.

An object of the invention is to provide a window guard which is easily and quickly (in much less than a minute) removable from the interior of the building, so that this window remain a safe escape passageway during a fire.

Another object of the invention is to provide a window guard of a type which is more appealing to the homeowner, so as to reduce the negative impression of „imprisonment„ of grid-type window guards.

Still another object of the invention is to provide such a window guard, which allows one to sleep at night with the window glass panes opened.

A general object of the invention is to provide such a window guard as a kit, of such easy installation as to be installed by the building owner himself.

A further object of the invention is that the window guard be such as to enable the building owner to install same from the interior of the window frame, thus preventing seasonality in the retail sales.

An object of this window guard is that the whole assembly thereof be dismantleable from the building window frame, for use in another building.

A general object of this invention is to address the safety needs of tenants by providing a low-cost version of the standard window safety grid.

SUMMARY OF THE INVENTION

In accordance with the hereinabove objects of the invention, there is disclosed a window guard for use within a window frame, said window frame being of the quadrangular type defining first and second pairs of opposite legs, said window frame having a substantial thickness defining interior and exterior marginal portions, said exterior marginal portion for use in supporting a partition chosen from the group comprising glass pane members and mosquito screen members, said window guard to be installed within said interior marginal portion of the window frame and comprising: (a) a pair of first and second, elongated, hollow stud members, each being made of a lightweight material and being of generally quadrangular cross-section whereby four stud walls are defined, a first one of said stud walls to be anchored by anchoring means to a corresponding one of said window frame legs, a second one of said stud walls being defined opposite said first stud wall; (b) a number of elongated, rigid rods, made of a sturdy, tamperproof material and each of a length greater than the distance between said pair of stud members, each rod defining opposite first and second end portions; (c) a number of bore means, mounted into said first stud member second wall and releasably axially engaged by a corresponding number of said rods first end portions; (d) a number of notch means, mounted into said second stud member second wall and being releasably transversely engaged by said rods second end portions; (e) channel means, anchored to said second wall of each said first and second stud member within the hollow thereof, at a distance from said first wall of the corresponding stud members, said channel means extending along a major portion of the length of said stud members and having transverse channel apertures to register with corresponding said bore means and notch means for free passage of corresponding said rods end portions; (f) first and second elongated skeleton members, being slidingly engaged into said channel means of corresponding said first and second stud members and of a length representing a substantial portion of the length of said channel means and of a shape generally conforming to that of channel means for smooth sliding motion therethrough, said skeleton member being made of a sturdy, tamperproof material and having transverse skeleton apertures to register with corresponding said bore means and notch means for free passage of corresponding said rods end portions; (g) latch means, for slidingly moving said second skeleton member through the corresponding said channel means between first and second positions, whereby hook means are provided to release said rods second end portions located in said notch means, in said first limit position of the second skeleton member, but to fixedly secure said rods second end portions, in said second limit position of the second skeleton member, whereby said rods second ends become trapped within said notch means upon said second skeleton member reaching its said second limit position; and (h) lock means, for preventing unauthorized actuation of said latch means.

DETAILED DESCRIPTION OF THE INVENTION

Figure 1A:
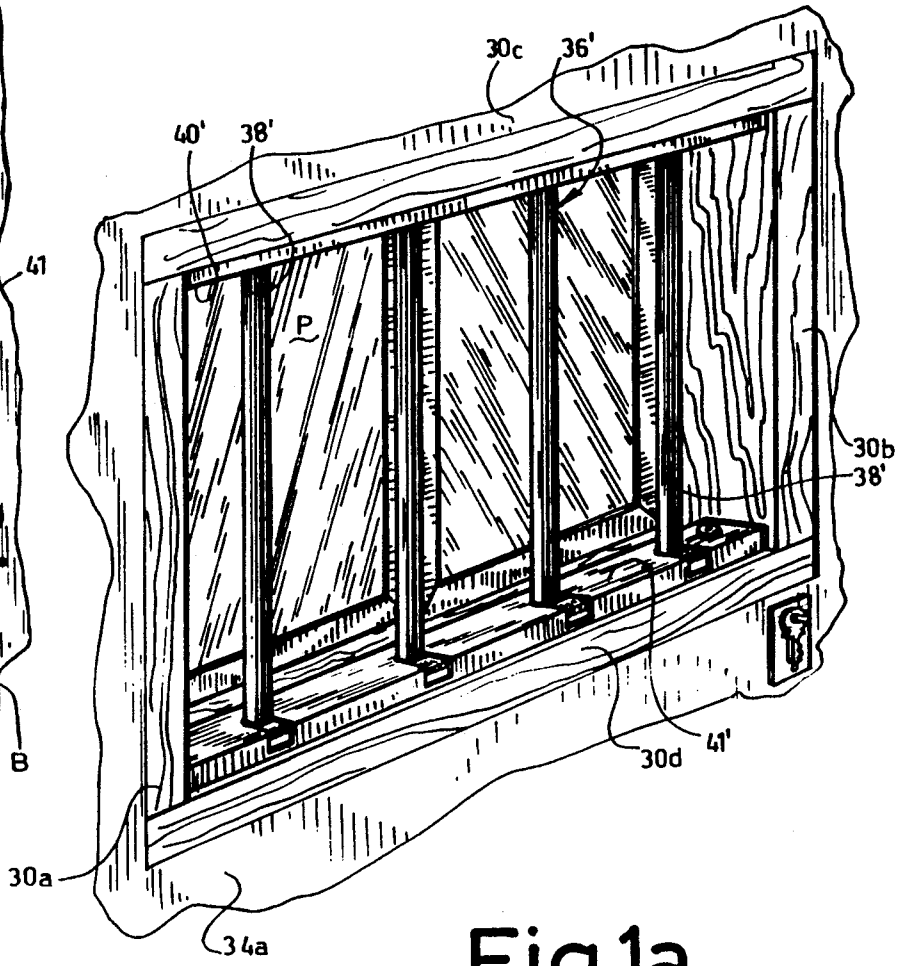
FIGS. 1 and 1*a* are isometric views of a window frame mounted to a building wall, showing two alternate embodiments of burglar-deterring devices of the invention located on the inner side of the window panes relative to the building inside volume.
Figure 1:
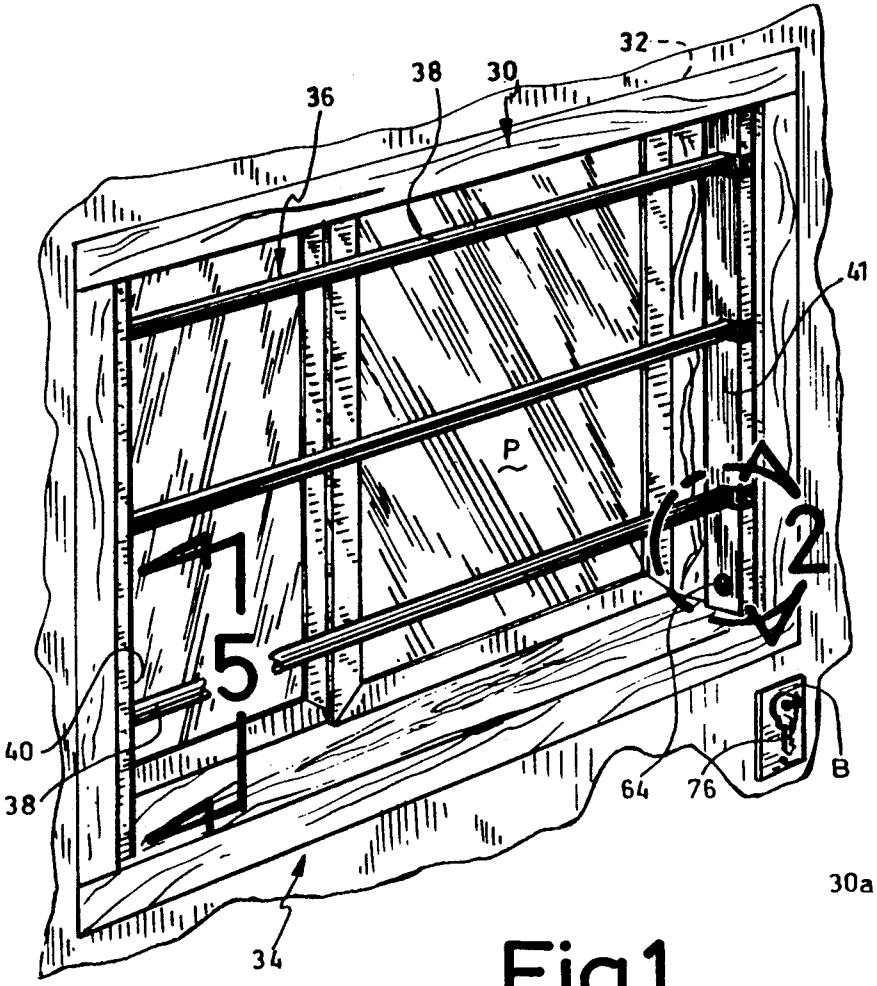
Figure 9:
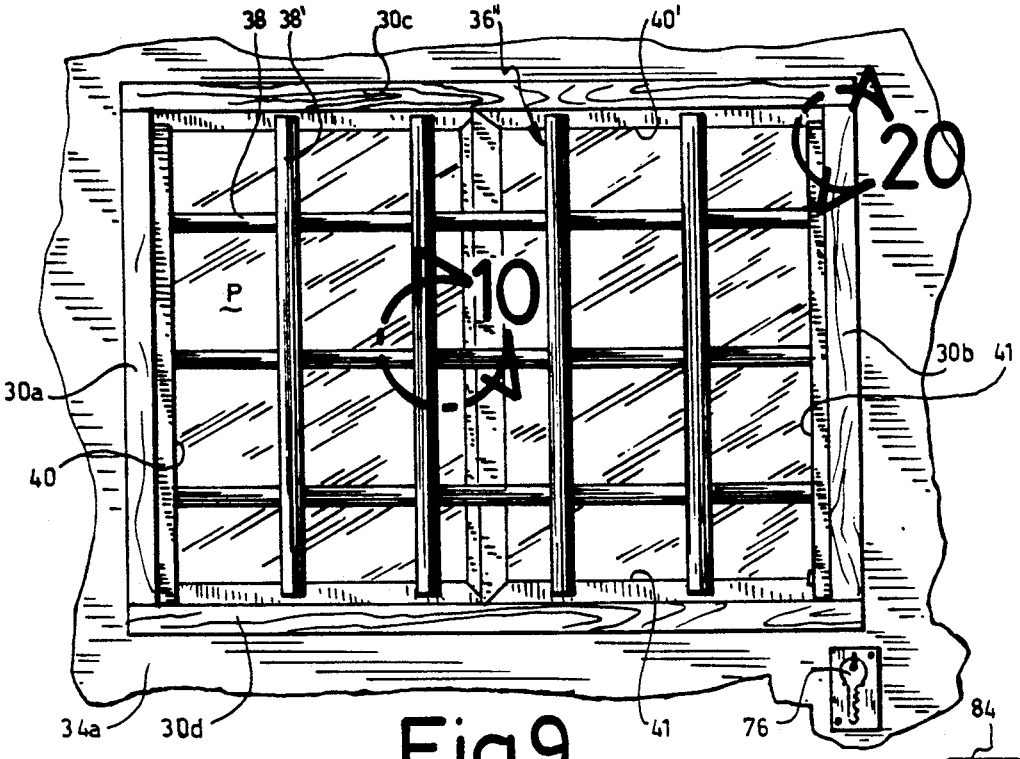
FIG. 9 is a front elevational of a window frame mounted to a building wall, showing a third alternate embodiment of burglar-deterring device of the invention located on the inner side of the window panes relative to the building inside volume.

As illustrated in FIGS. 1, 1*a*, and 9, the window frame 30 conventionally fits inside a quadrangular aperture 32 made in the upright wall 34 of a building. Window frame 30 includes two lateral side legs 30*a*, 30*b*, a top leg 30*c* and a bottom leg 30*d*. The building wall 34 defines an interior face, 34*a*, (opening into the building interior volume) and an exterior face (not shown). Aperture 32 has a substantial thickness, whereby the quadrangular window frame 30 defines an exterior marginal portion and an interior marginal portion. Window panes P (or alternately, sashed mosquito screen or any other weather-proof or bug-controlling partition) are installed along the exterior marginal portion of the window frame. Sashed window panes P may be of the horizontally slidable type, as illustrated, or may be vertically slidable, or outwardly tiltable, or alternately, be fixedly anchored in position; the particular type of slidable partition P is irrelevant to the present invention.

According to the invention, a removable window guard 36 is provided, being fitted along the interior marginal portion of the window frame 30, i.e. interiorly relative to glass pane P. The window guard 36 includes a number of substantially identical cross-bars 38, and one pair of opposite studs 40, 41, located at the opposite ends of the cross-bars 38 and anchored to respective legs of the window frame 30. The cross-bars 38 are releasably connected to the studs 40, 41. Release of the cross-bars 38 can be done only from the inside of the building.

In the first embodiment of window guard 36, shown in FIG. 1, the cross-bars 38 extend horizontally, and the studs 40, 41, being engaged by the lateral side legs 30*a*, 30*b*, of the window frame 30. In the second embodiment of window guard 36', shown in FIG. 1*a*, the cross-bars 38, extend vertically, and the studs 40', 41', fit into the top and bottom window legs 30*c*, 30*d*, respectively.

Figure 10:
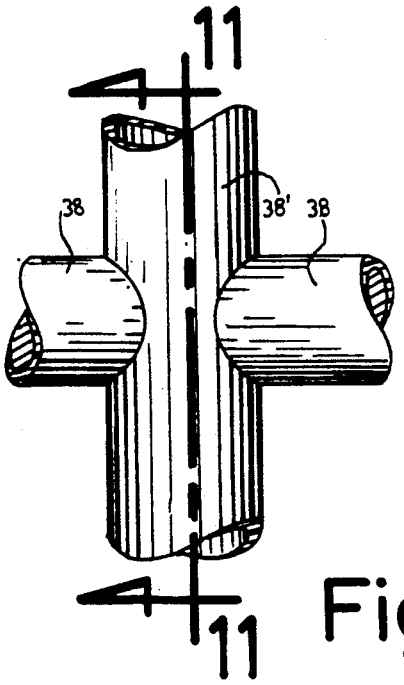
FIG. 10 is an enlarged view of area 10 in FIG. 9.
Figure 11:
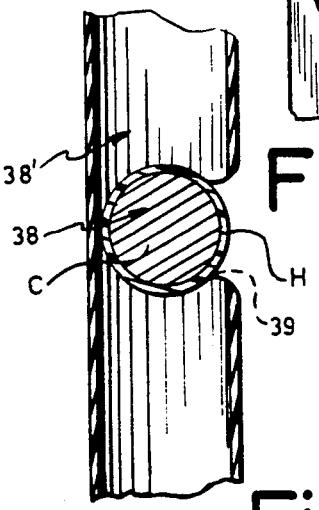
FIG. 11 sectional view along line 11—11 of FIG. 10.

In the third embodiment of window guard 36'', shown in FIG. 9, a first set of cross-bars 38 extend horizontally, with the corresponding studs 40, 41, being engaged by the opposite lateral side legs 30*a*, 30*b*; and a second set of cross-bars 38' extend vertically, being anchored to the first set of cross-bars 38 at their cross-points (FIGS. 10-11). The two sets of cross-bars 38, 38', are located within two vertical planes which are spacedly offset from one another relative to the thickness of the window aperture 32. The horizontal rods 38 simply extend through corresponding cylindrical channels 39 made at selected intervals along the vertical rods 38'. Each channel 39 is for example closed on one side thereof (left hand side of FIG. 11), but opened on the opposite side thereof (right-hand side of FIG. 11). Vertical bars 38' are provided only for aesthetic reasons, and are therefore not designed to enhance the sturdiness and burglar-resistant features of the window guard. However, this third embodiment of window guard is not the preferred embodiment, because of overall weight and capital cost considerations.

As shown in FIGS. 10–11, the bars or rods 38, 38', should be made from a sturdy, rigid material at their core C. Iron or a metallic alloy is preferred; advantageously, this metal core will be covered by a plastic (e.g. PVC) sheath, H.

Figure 5:
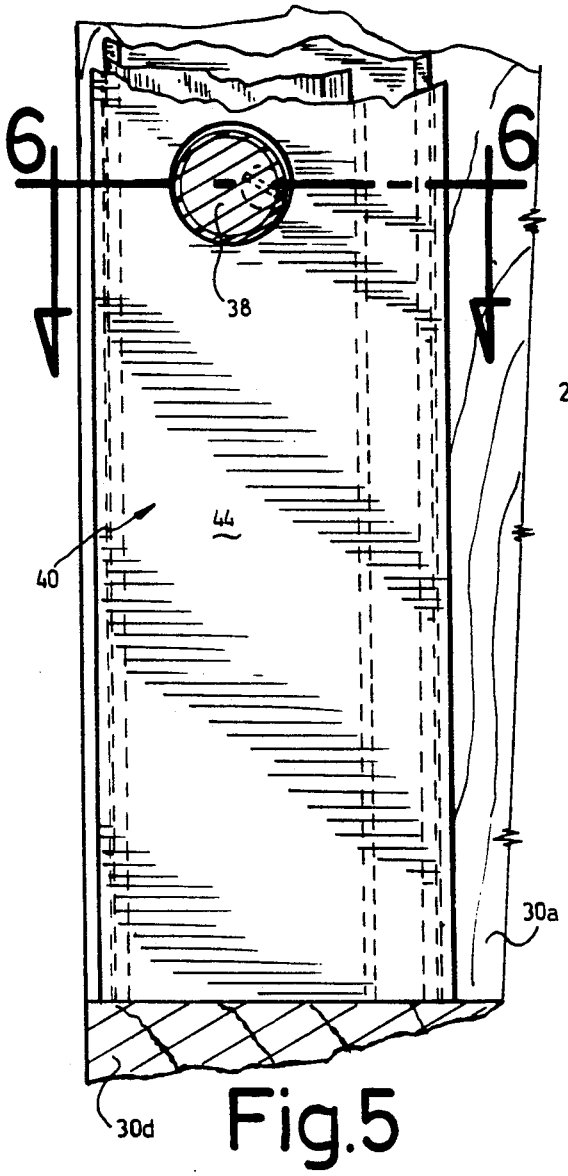
FIG. 5 enlarged view of the inner face of the lateral stud from perspective 5 of FIG. 1, taken sectionally through a horizontal bar.
Figure 6:
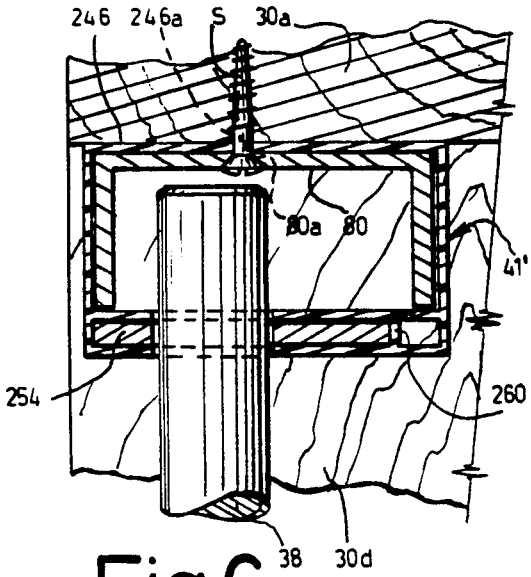
FIG. 6 is a sectional view along line 6—6 of FIG. 5.
Figure 13:
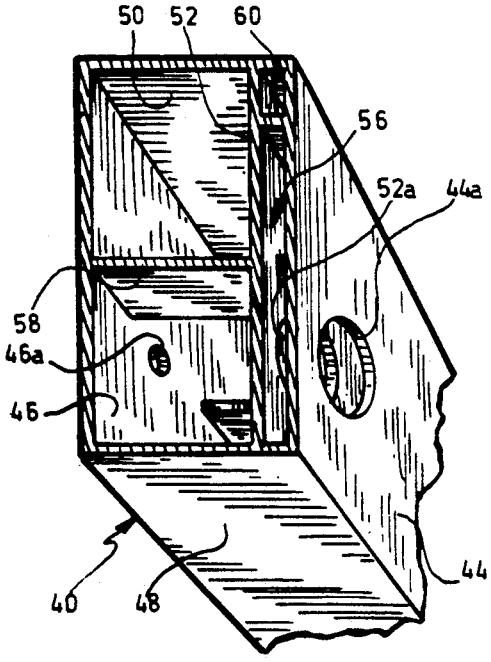
FIGS. 13 and 14 are isometric, fragmentary views or the two lateral studs from FIG. 12.

FIGS. 5–6 suggest how the left-hand end portions of the horizontal guard rods 38 of FIG. 1 or 9 become engaged into the corresponding stud 40. This stud 40 is shown in broken, isometric view in FIG. 13. Stud 40 forms a tubular extrusion, of quadrangular cross-section defining four side walls 44, 46, 48 and 50. Opposite walls 48 and 50 are joined by a lightweight partition being closely spaced of inner wall 44. Walls 44, 46 and 52 have a number of generally coaxial bores 44*a*, 46*a*, 52*a*, respectively, corresponding to the number of window guard bars 38. Bores 44*a* and 52*a* are diametrally larger than rods 38, to allow free axial passage of the end portions of these rods therethrough. Bore 46*a* is much smaller in diameter relative to bores 44*a* and 52*a*, and is freely engaged by a screw S driven into the wooden leg 30*a* of window frame 30, whereby the stud 40 is anchored to the window frame 30.

Bore 46*a* is aligned with bores 44*a* and 52*a*, so as to allow easy access to bore 46*a* through bores 44*a* and 52*a*, for driving screw S into wood 30*a* or for unscrewing screws (with a screwdriver tool). This alignment of bores 44a, 46a, 52a is preferred, because it allows release of studs 40 (and 41) from window frame 30, i.e. that the owner may choose to remove the window guard 36 and carry same with him when moving out from a house.

Figure 12:
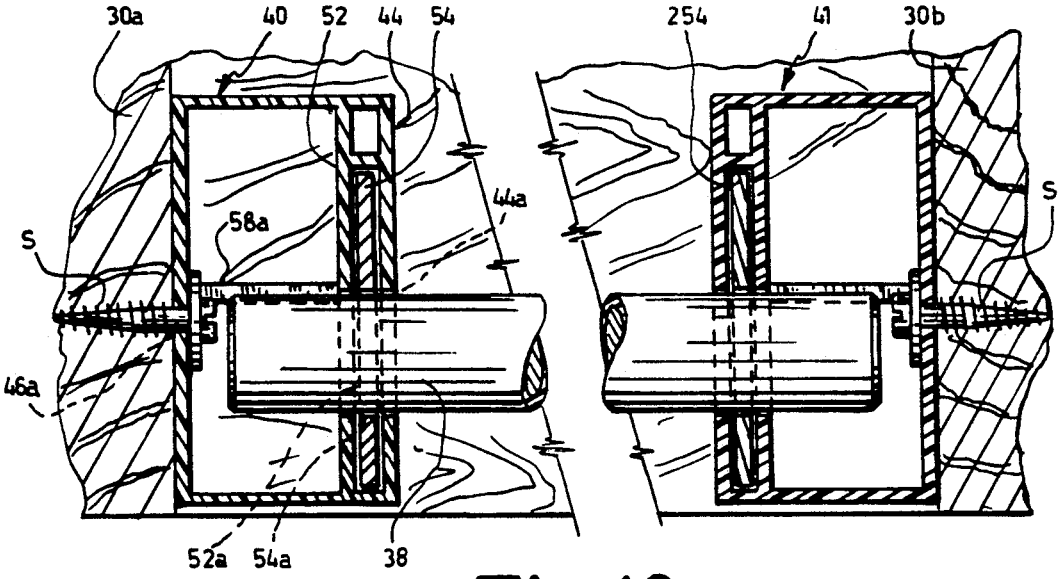
FIG. 12 a cross-section of one embodiment of pair of opposite lateral studs from one of the window frames, showing one horizontal bar in fragmentary view.

As suggested in FIG. 6 and in the left hand side of FIG. 12, a sturdy, reinforcing, rectangular, flat, metallic plate 54 is freely engaged into the narrow channel 56 defined between proximate parallel walls 52 and 44. Plate 54 has bores 54a diametrally similar to and coming in register with corresponding pairs of bores 44a and 52a, for free passage of rods 38.

Preferably, there is provided a reinforcing partition 58 joining walls 46 and 52 at mid-distance from walls 48 and 50 of stud 40. Partition 58 is made of the same light-weight material as walls 44–52, being preferably PVC (polyvinyl chloride, a plastic). Preferably also, metal plate 54 has a width being substantially less than the distance between walls 48 and 50, although greater than half said distance, in order again to maintain stud height to a minimum.

Advantageously, wall 52 will be joined to proximate wall 44 by a short partition 60, at such a distance from wall 50 that quadrangular plate 54 will slidingly abut edgewisely against partitiono 60 and the opposite small fraction of wall 48 in register therewith, whereby no play for tilt of plate 54 within channel 56 will remain. The purpose of partition 60 will become clear upon commenting the opposite stud 41 (hereinbelow) which, for economies of scale, will be made from the same extrusion beam as stud 40. Partition 58 will also have cut-outs 58a (FIG. 12), in register with each quadruplet of aligned bores 46a, 52a, 54a, 44a, to clear the way for the (relatively massive) rod 38.

Figure 14:
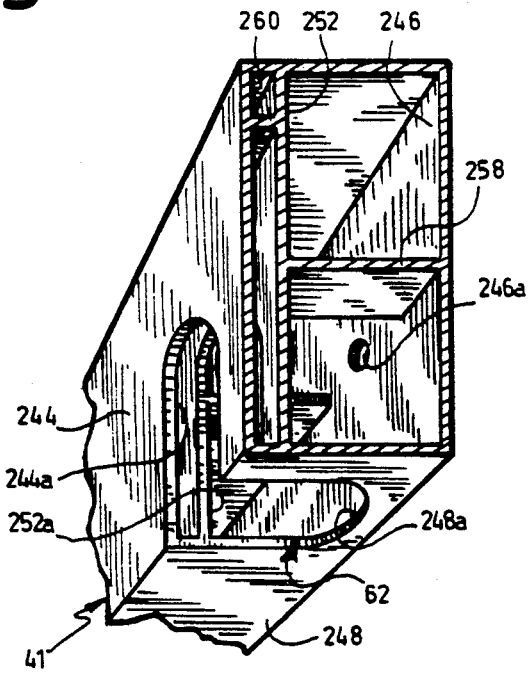

As illustrated in FIGS. 12 and 14, studs 40 and 41 are from the same extrusion and thus, construction. Features in stud 41 corresponding to those in stud 40 will be referenced by 200-series numerals. The only difference between the studs 40 and 41 is the L-shape notching of bore 44a and 52a of stud 40, along walls 244 and 248 of stud 41 (FIG. 14), to define notch 62. Notch 62 is double-decked (about notch portions 252a, 244a), at the inner face of stud 41, since there are two closely parallel partitions 252 and 244, but single-decked about portion 248a of wall 248. The width of notch 62 about walls 244 and 252 is similar to the diameter of rod 38, to allow free engagement of the corresponding rod end portion thereof, while the depth of notch 62 through wall 248 is sufficient to enable the latter rod end portion to slidingly escape therethrough to clear stud 41, thereby allowing release of rod 38 from opposite stud 40 by axial pulling of rod 38 outwardly from aligned bores 46a, 52a, 54a and 44a of that opposite stud 40.

Figure 3:
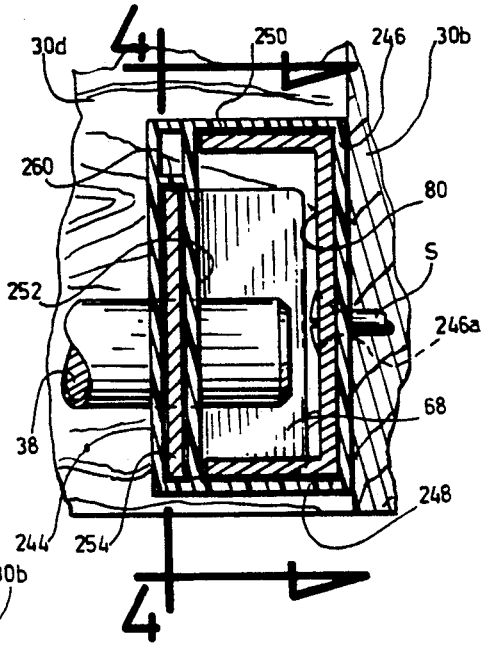
FIG. 3 is a cross-section taken along broken line 3—3 of FIG. 2.
Figure 4:
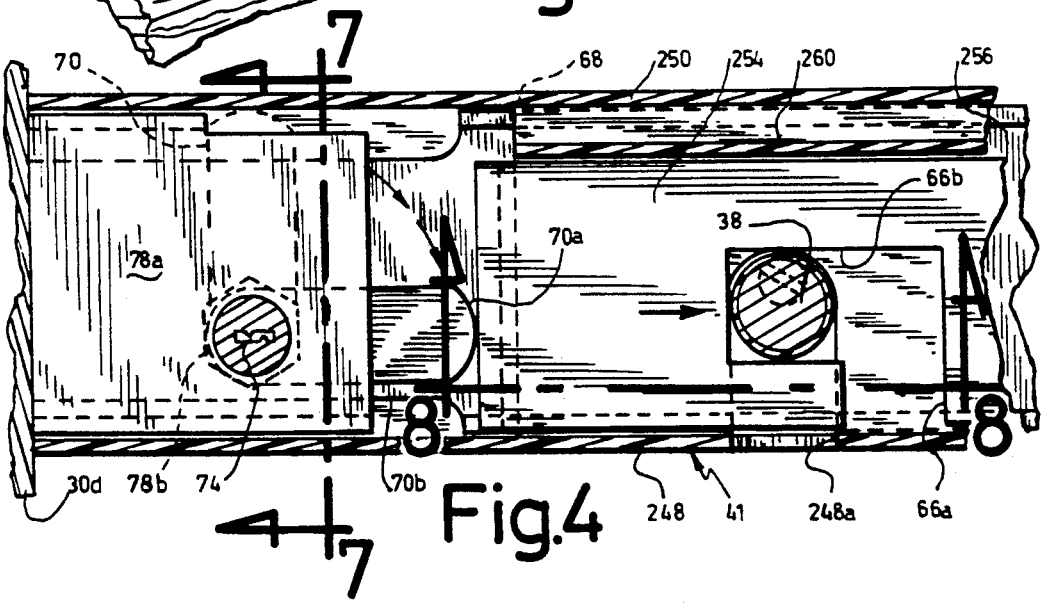
FIG. 4 is a sectional view along line 4—4 of FIG. 3 rotated 90 degrees clockwise.

Releasable locking means 64 are provided to prevent release of each rod 38 from its corresponding stud notch 62 (and thus relese of rod 38 from studs 41 and 40). Such locking means 64 are detailed in FIGS. 2–4, 7–8 and 15–19 of the drawings. Means 64 includes a rectangular plate 254, being slidably engaged into channel 256. Plate 254 includes a number of L-shape recesses 66, each of a width slightly greater than the diameter of a corresponding rod 38 for free through engagement by the latter (FIG. 4). Each L-shape recess 66 includes a transverse leg 66a, opening outwardly of the plate 254, and a lengthwise leg 66b merging at its upper end with the transverse leg 66a. Rectangular plate 254 is movable between a first position (not illustrated), in which all of the transverse recess legs 66a come in direct register with all the corresponding bores 248a of the stud inner wall 248, and a second position, illustrated in FIG. 4, in which the recess legs 66a become offset from these bores 248a lengthwisely of rectangular plate 254. It is understood that in said first position of plate 254, the locking means 54 are in their "unlocked" mode, since the corresponding end portion of rods 38 may be freely released from stud 41 through recess legs 66b, 66a, and bores 248a; while in said second position of plate 254, the locking means 64 are in their "locked" mode, since the rods 38 inside plate recess 66 cannot escape ports 248a.

For controlling (vertical) sliding motion of rectangular plate 254 through hollow upright stud 41, between its said first and second positions, there is provided an integral transverse flap 68 at the bottom edge of upright plate 254. As best seen in FIG. 3, flap 68 extends about most but not all of the sectional area of the inner tubular volume defined by stud walls 250, 246, 248, and 252. Flap or tab 68 forms a horizontal seat against which abuts a rectangular lever arm 70 which is pivotally carried by a horizontal pivotal member 72 (FIG. 7), the latter being transversely carried by and projecting outwardly from inner stud wall 244.

Pivot member 72 consists of a locking barrel, with the keyslot part thereof, 74, projecting through and beyond inner stud wall 244. A loose key 76 (FIG. 1) operates keyslot 74, to rotate lock barrel 72 to bring lever arm 70 from a first horizontal position, illustrated in phantom lines in FIG. 4, to a second upright position, illustrated in full lines in FIG. 4. It is understood that in said second position of lever arm 70, its short arcuate free end 70a abuts against flap 68 to raise integral plate 254 to move recess leg 66a out of register from stud bore 248a. As the lever arm 70 is brought (with key 76) from said second to said first position thereof, plate 254 will fall by its own weight until its flap 68 comes to abut flatly against the long straight side edge 70b of lever arm 70.

Hence, by rotating key 76, the corresponding end portions of rods 38 will automatically be locked to or unlocked from stud 41. For fire safety considerations, key 76 must be readily accessible to occupants within the house, and thus, should be located proximate window 30, for example hooked to a bracket B (FIG. 1) fixed to the house upright wall 34, but beyond an arm's length distance from window 30, to prevent unauthorized access thereto by a burglar having broken the window panes P.

Figure 7:
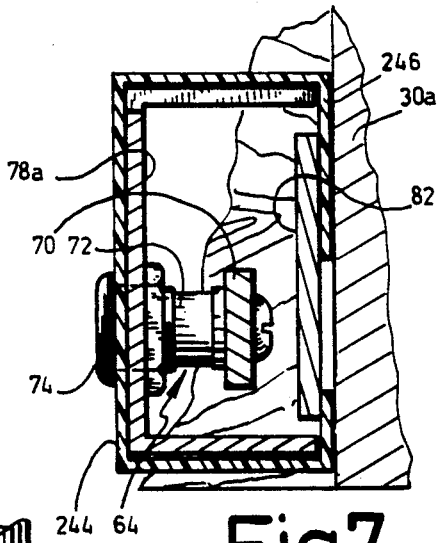
FIGS. 7—8 are cross-sections taken about lines 7—7 and 8—8 respectively of FIG. 4.
Figures 15, 16, 17, 18, 19:
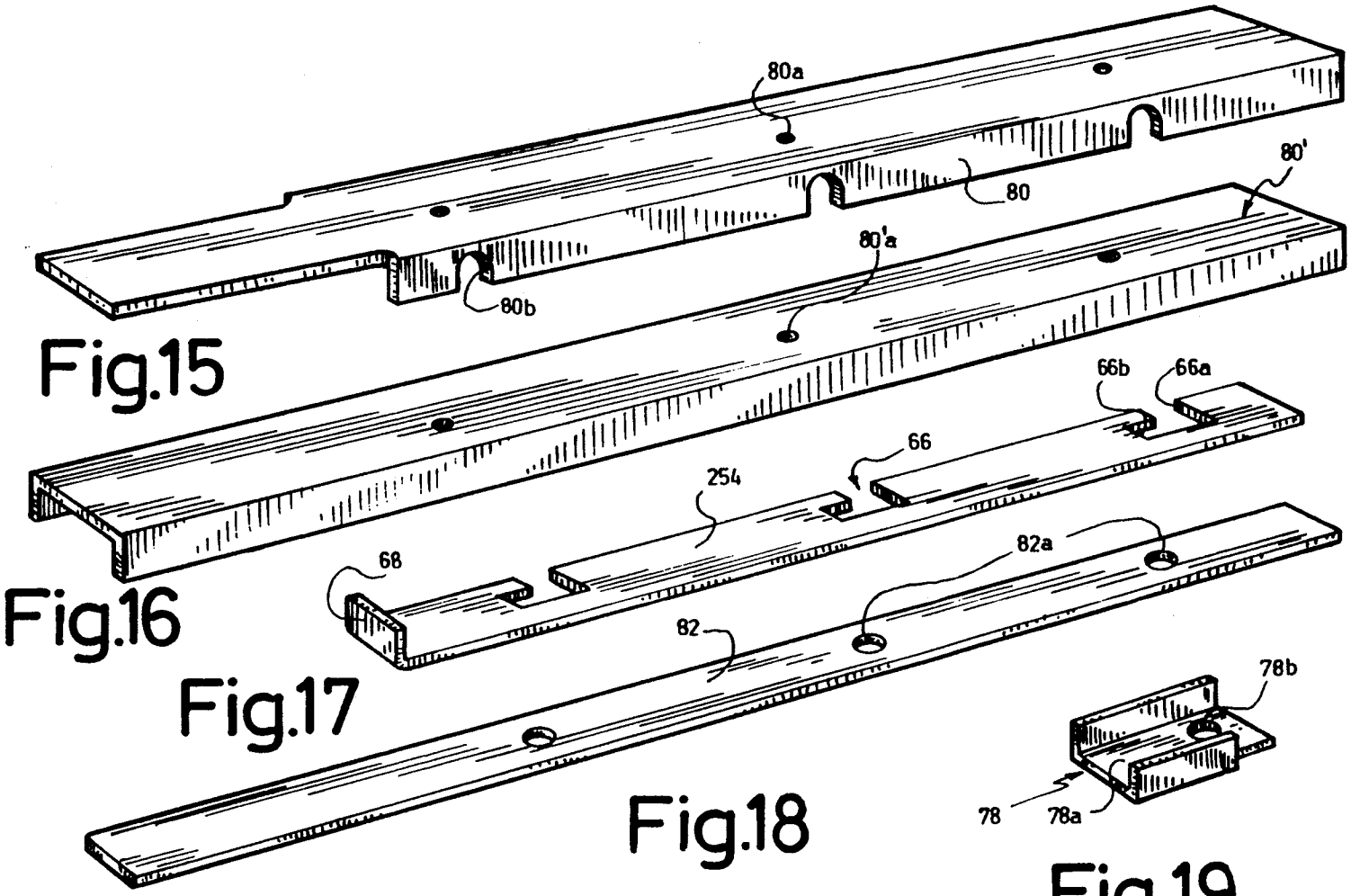
FIGS. 15–19 exploded, isometric views of the various elements of the lateral studs from FIG. 12.

Most preferably, and as illustrated in FIGS. 4, 7 and 19, lock means 70–74 should be shielded by a generally cross-sectionally U-shape metallic, tamperproof frame 78, to prevent unauthorized access to lock barrel 72 via frangible PVC wall 244. Accordingly, the web 78a of metal U-frame 78 is bored at 78b, to allow through passage of the intermediate core of barrel 72.

In an alternate embodiment of lock stud 41, illustrated as 41' in FIG. 6, the lightweight, flat, PVC-based partition 258 is replaced by a sturdy, cross-sectionally U-shape metallic frame 80, (see also FIG. 15) abutting against stud walls 246, 248, 250. U-frame 80 includes bores 80a along its web, to register with corresponding bores 246a in stud wall 246, for driving screw members S therethrough into wooden leg 30a, to anchor reinforcing frame 80 to the window frame 30, and notches 80b for coming in register with the notches 62 of stud walls 244 and 248.

Of course, such a U-frame arrangement (80) could also be used within the opposite hollow stud 40, and illustrated as 80, in FIG. 16. U-frame 80' would not need any lateral notch, since the body of stud 40 is only bored along wall 44 thereof, but not notched along the wall 48 (one of the two side legs of U-frame 80' abuts flatly against the corresponding wall 248 of stud 41, which thus required the notching of this wall to match the notches 248a (FIG. 14) in wall 248.

Figure 8:
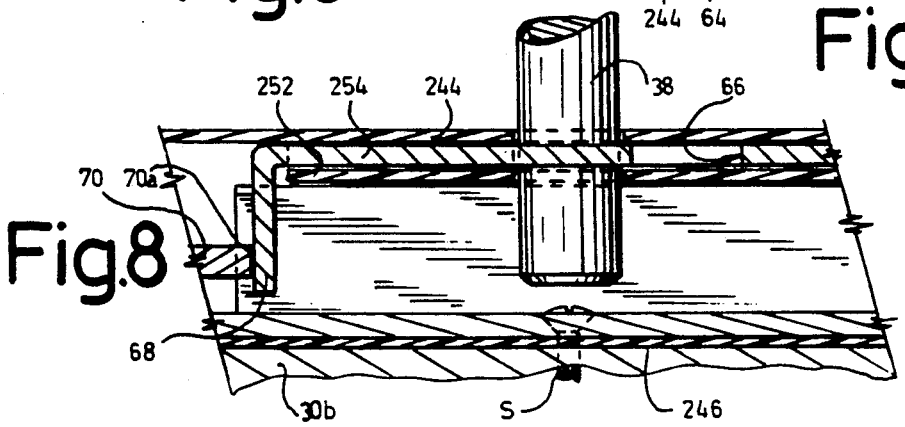

Or, alternatively, and as illustrated in FIGS. 7–8 and 18, when a lock barrel shield frame 78 is used, U-frame 80 is preferably replaced by a simple rectangular metallic plate 82. Reinforcing plate 82 abuts against wall 246, and has bores 82 again for through-engagement by screw S.

The total length of lever arm 70 of the lock means 64 need not be as long as the internal width of stud 41, i.e. the distance between walls 248 and 250—see FIG. 4—, for lever arm 70 to be effective in raising the locking plate flap 68. This is why partition 260 is provided, because lock plate 254 need not be as wide as the stud for lever arm arcuate end 70a to effectively reach lock plate flap 68. For optimum sliding performance of lock plate 256 inside its stud channel, it is desirable that:

a) metallic plate 254 come in contact with metal-less material of channel walls 260, 252, 248 (small fraction) and 244 (large fraction), and preferably, these channel walls will then be for that reason made of PVC, because PVC metal shearing surfaces provide excellent sliding capabilities (low frictional ratios);

(b) said channel 244, 248, 252, 260 be of such a width and depth as to substantially match the external format of slider plate, 254, so as to prevent any undesirable swinging play or "fluttering" of slider plate 254 within the latter channel during sliding motion therethrough.

Moreover, reducing the width of slider plate 254 desirably reduces the overall weight of stud 41. Hence, the purpose of partition 260, which reduces the overall inner volume of the slider plate channel 244, 248, 252, 260 for the (heavy) slider plate.

Figure 20:
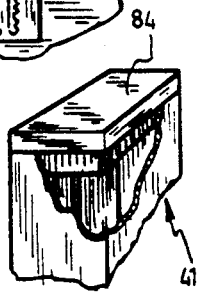
FIG. 20, on the fourth sheet of drawings, is a cutaway view, at an enlarged scale, of one end of a lateral stud in the area circumscribed by arrow 20 in FIG. 9.

Preferably, and as illustrated in FIG. 20, the top end of each hollow, vertical stud 40, 41, is closed by a weatherproof plug cap 84.

Figure 2:
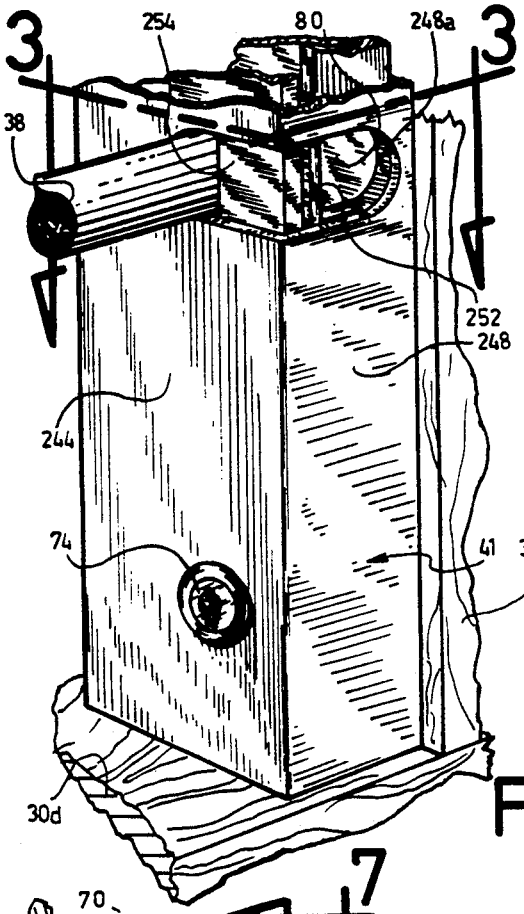
FIG. 2 is a view at an enlarged scale of the area circumscribed by arrow 2 in FIG. 1.

As illustrated in FIG. 2, the portions of shield plates 254, 80 in register with stud notch 62, effectively prevent unauthorized access into stud 40 through notch 62 and recess 66.

The second embodiment of the invention in FIG. 1a is similar to the one in FIG. 1, except that the studs 40', 41', extend horizontally along the top and bottom legs 30c, 30d of the window frame 30, rather than vertically. Obviously, the slider plate 254 inside the lock stud 41 will not be able to return by itself (i.e. by its own weight) from its rod-locking to its rod-releasing positions, since rectangular plate 254 will extend horizontally with the stud 41'. The window guard 38' would then become permanently anchored to the window frame. Alternatively, access to the slider plate 254 could be reached—upon unlocking lock 64 with key 76—by removing plug cap 84 (FIG. 20) at the end of stud 41 opposite locking barrel 72 (this stud end would be slightly spaced from the window frame leg 30a), inserting the forefinger and pushing the slider plate end toward opposite window frame leg 30b.

Preferably, the material selected for the stud members, including the channel members, is chosen from the group comprising: lightweight PVC material, aluminum, or an aluminum alloy.

I claim:

1. A window guard for use within a window frame, said window frame being of the quadrangular type defining first and second pairs of opposite legs, said window frame having a substantial thickness defining interior and exterior marginal portions, said exterior marginal portion for use in supporting a partition chosen from the group comprising glass pane members and mosquito screen members, said window guard to be installed within said interior marginal portion of the window frame and comprising:

(a) a pair of first and second, elongated, hollow stud members, each being made of a lightweight material and being of generally quadrangular cross-section whereby four stud walls are defined, a first one of said stud walls to be anchored by anchoring means to a corresponding one of said window frame legs, a second one of said stud walls being defined opposite said first stud wall;

(b) a number of elongated, rigid rods, made of a sturdy, tamperproof material and each of a length greater than the distance between said pair of stud members, each rod defining opposite first and second end portions;

(c) a number of bore means, mounted into said first stud member second wall and releasably axially engaged by a corresponding number of said rods first end portions;

(d) a number of notch means, mounted into said second stud member second wall and being releasably transversely engaged by said rods second end portions;

(e) channel means, anchored to said second wall of each said first and second stud member within the hollow thereof, at a distance from said first wall of the corresponding stud members, said channel means extending along a major portion of the length of said stud members and having transverse channel apertures to register with corresponding said bore means and notch means for free passage of corresponding said rods end portions;

(f) first and second elongated skeleton members, being slidingly engaged into said channel means of corresponding said first and second stud members and of a length representing a substantial portion of the length of said channel means and of a shape generally conforming to that of channel means for smooth sliding motion therethrough, said skeleton member being made of a sturdy, tamperproof material and having transverse skeleton apertures to register with corresponding said bore means and notch means for free passage of corresponding said rods end portions;

(g) latch means, for slidingly moving said second skeleton member through the corresponding said channel means between first and second positions, whereby hook means are provided to release said rods second end portions located in said notch means, in said first limit position of the second skeleton member, but to fixedly secure said rods second end portions, in said second limit position of the second skeleton member, whereby said rods second ends become trapped within said notch means upon said second skeleton member reaching its said second limit position; and (h) lock means, for preventing unauthorized actuation of said latch means.

2. A window guard as defined in claim 1, wherein said first and second stud members are formed from a same extruded beam.

3. A window guard as defined in claim 2, wherein said extruded beam including said channel means are made from PVC, and said skeleton members are made from a strong metal, whereby sliding motion of said second skeleton member through its corresponding said channel means is almost frictionless.

4. A window guard as defined in claim 3, further including a reinforcing frame, of U-shape cross-section and made from tamperproof metallic material, said reinforcing frame being anchored to said first wall of each corresponding said stud member within the hollow thereof and lining the two adjacent other walls of each said stud member.

5. A window guard as defined in claim 4, wherein said first and second elongated stud members extend generally vertically, and said latch means includes:

(a) a rigid flap, transversely secured to the bottom end of said second skeleton member;

(b) an elongated lever arm, movable within the hollow of said second stud member; and (c) pivot means, pivotally mounting said lever arm transversely to said second wall of second stud member;

wherein said lever arm defines a short free end and an elongated straight side edge, said lever arm being rotatable between horizontal and upright positions so that its free end abut against said second skeleton member flap, in said second limit position of the second skeleton member, while its side leg abut against said second skeleton flap, in said first limit position of the second skeleton member.

6. A window guard as defined in claim 5, wherein said pivot means consists of a lock barrel, said lock barrel defining a keyslot part projecting outwardly from said second stud member second wall; said control means consisting of a loose key, releasably engageable through said keyslot part for enabling rotation of said lever arm within the hollow of said second stud member.

7. A window guard as defined in claim 6, wherein said reinforcing frame extends short of said lock barrel, and further including a shield casing for said lock barrel, said shield casing being made from a tamperproof metallic alloy and of U-shape cross-section, said shield casing mounted within the hollow of said second stud member to said first wall thereof and lining the two adjacent other walls thereof, said shield casing having aperture means for through passage of said lock barrel exclusively of said lever arm.

8. A window guard as defined in claim 1, wherein each said stud member includes screw means, for anchoring same to said window frame, said screw means being mounted to said first wall of the corresponding stud member and being in axial alignment with respective said bore means and notch means, to enable easy installation and removal of the window guard relative to the window frame, said screw means being positively inaccessible to unauthorized persons and concealed by said rods when said rods are engaged into said bore and notch means.

9. A window guard as defined in claim 1, further including a shield casing for said lock barrel, said shield casing being made from a tamperproof metallic alloy and of U-shape cross-section, said shield casing mounted within the hollow of said second stud member to said second wall thereof and lining the two adjacent other walls thereof, said shield casing having aperture means for through passage of said lock barrel exclusively of said lever arm.

10. A window guard as defined in claim 1, wherein each said rod is provided with a PVC sheathing.

* * * * *